US007351086B2

(12) United States Patent
Shiota et al.

(10) Patent No.: US 7,351,086 B2
(45) Date of Patent: Apr. 1, 2008

(54) CONNECTOR

(75) Inventors: Koji Shiota, Osaka (JP); Yoichi Murakami, Nishikamo-gun (JP)

(73) Assignee: J.S.T. Mfg. Co., Ltd., Osaka-shi (JP)

( * ) Notice: Subject to any disclaimer, the term of this patent is extended or adjusted under 35 U.S.C. 154(b) by 0 days.

(21) Appl. No.: 11/759,735

(22) Filed: Jun. 7, 2007

(65) Prior Publication Data

US 2007/0287320 A1 Dec. 13, 2007

(30) Foreign Application Priority Data

Jun. 8, 2006 (JP) ..... 2006-160173

(51) Int. Cl.
*H01R 12/24* (2006.01)

(52) U.S. Cl. ..... 439/292

(58) Field of Classification Search ..... 439/495, 439/496, 492

See application file for complete search history.

(56) References Cited

U.S. PATENT DOCUMENTS 5,501,610 A * 3/1996 Ikemoto ..... 439/498
6,276,958 B1 * 8/2001 Chih ..... 439/495
6,280,240 B1 * 8/2001 Chang ..... 439/495
6,939,166 B2 * 9/2005 Chung ..... 439/495
7,077,690 B2 * 7/2006 Zhang et al. ..... 439/495

FOREIGN PATENT DOCUMENTS

JP 2004-139916 5/2004

* cited by examiner

*Primary Examiner*—Briggitte R. Hammond
(74) *Attorney, Agent, or Firm*—Oblon, Spivak, McClelland, Maier & Neustadt, P.C.

(57) ABSTRACT

A connector includes a housing in which a recess having an opening on a rear face is provided, and a slider to be slid in the recess. A flexible substrate is inserted in the recess with the slider so that a contact on the flexible substrate is connected to a contact on the housing. On both sides of the slider, a pair of lock arms are provided for fixing the slider to the housing when the slider is fitted in the housing. Parts of the respective lock arms in the recess are exposed out of the housing at portions near both sides of the upper face of the housing when the slider is fitted in the housing, and either of the lock arms in the recess are not exposed out of the housing when the slider is not fitted in the housing. Each portion of the housing where each lock arm is exposed is provided near a corner portion where the upper face, a side face, and a front face of the housing are perpendicularly connected to each other.

8 Claims, 15 Drawing Sheets

CONNECTOR

BACKGROUND OF THE INVENTION

1. Field of the Invention

The present invention relates to a connector to be used for electrically connecting conductors to each other, in particular, to a side type connector, that is, a horizontally attaching type connector, in which a flexible substrate is inserted and pulled out parallel to a mounting surface.

2. Description of Related Art

Japanese Patent Unexamined Publication No. 2004-139916 discloses a connector in which a socket housing as a slider, which is formed into a female connector, is fitted into a base connector as a housing, which is formed into a male connector and mounted on a printed circuit board, parallel to the mounting surface of the printed circuit board. In the connector, a socket contact supported on the socket housing is brought into contact with a pin contact supported on the base connector to electrically connect the socket contact to the printed circuit board.

In the side type connector disclosed in the publication, a worker must move the socket housing parallel to the mounting surface of the printed circuit board in order to fit the socket housing into the base connector. However, this operation is performed manually and the worker is hard to apply a force to the socket housing. As a result, the socket housing may be put into a non-fitted or semi-fitted state to the base connector.

For this reason, in order to confirm the fit between the socket housing and the base connector, a connector is proposed that is provided with a lock mechanism for fitting the socket housing into the base connector with a latch sound or a latch feeling. In the connector, however, the confirmation of the fit depends on the hearing sense or the sense of touch of the worker. Therefore, when the fitting operation is performed in a factory in which noises or vibrations are generated, the worker is apt to erroneously confirm the fit though the socket housing is in a non-fitted or semi-fitted state.

SUMMARY OF THE INVENTION

An object of the invention is to provide a side type connector in which a worker is easy to confirm the fit between a housing and a slider.

A connector of the present invention comprises a housing on which a contact is attached. The housing comprises a recess extending parallel to a mounting surface of a printed circuit board on which the housing is to be mounted. The recess comprises at its rear end an opening. The connector further comprises a slider to be inserted in the recess through the opening, and slid in the recess to be fitted in the housing. A flexible substrate is to be inserted in the recess with the slider so that a contact on the flexible substrate is connected to the contact on the housing. The slider comprises on its both sides a pair of lock arms to fix the slider to the housing when the slider is fitted in the housing. Parts of the respective lock arms in the recess are exposed out of the housing at portions of the housing near both sides of an upper face of the housing when the slider is fitted in the housing, and either of the lock arms in the recess are not exposed out of the housing when the slider is not fitted in the housing. Each portion of the housing where each lock arm is exposed out of the housing is provided near a corner portion where the upper face, a side face, and a front face of the housing are perpendicularly connected to each other.

According to the invention, in operating the slider or a checking process, a worker can check with eyes whether or not the slider has been fitted in the housing. This scarcely causes erroneous confirmation even under an environment in which noises or vibrations are being generated.

In addition, because each portion of the housing where each lock arm is exposed out of the housing is provided near a corner portion where the upper face, a side face, and the front face of the housing are perpendicularly connected to each other, each portion of the housing where each lock arm is exposed can be formed at an accurate position. The upper face of the housing is a face of the housing facing in the same direction as the mounting surface of the printed circuit board. A rear face of the housing is a face of the housing on which the opening is formed. The front face of the housing is a face of the housing opposite to the rear face.

In the connector, the housing and the slider are preferably different in color. According to this feature, a worker can clearly see the lock arms being exposed out of the housing.

In the connector, it is preferable that front ends of the respective lock arms in an insertion direction of the slider into the recess are exposed out of the housing when the slider is fitted in the housing. According to this feature, on the basis of whether or not the front end portions of the slider inserted in the recess of the housing are exposed out of the housing, a worker can check with eyes whether or not the slider has been fitted in the housing.

In the above case, it is preferable that the housing comprises first cutouts formed at a front end of the upper face of the housing, and the front ends of the lock arms are exposed through the respective first cutouts when the slider is fitted in the housing. According to this feature, the front end portions of the slider are exposed through the respective first cutouts when the slider has been fitted in the housing.

In the connector, it is preferable that two portions of each lock arm are exposed out of the housing when the slider is fitted in the housing. According to this feature, a worker can more surely check whether or not the slider has been fitted in the housing.

In the above case, the connector may be constructed so that each lock arm is elastically deformable perpendicularly to an insertion direction of the slider into the recess; each lock arm comprises on its outer side surface a protrusion, and the housing comprises on its both sides a pair of engagement faces that engage with the protrusions of the respective lock arms so as to prevent the slider from sliding in the direction opposite to the insertion direction when the slider is fitted in the housing; and the housing further comprises a pair of through holes at portions of the housing near both sides of the upper face of the housing, the protrusions of the lock arms in the recess are exposed through the respective through holes when the slider is fitted in the housing, and the protrusions of the lock arms in the recess are not exposed through the through holes when the slider is not fitted in the housing.

Alternatively, the connector may be constructed so that each lock arm is elastically deformable perpendicularly to an insertion direction of the slider into the recess; each lock arm comprises on its outer side surface a protrusion, and the housing comprises on its both sides a pair of engagement faces that engage with the protrusions of the respective lock arms so as to prevent the slider from sliding in the direction opposite to the insertion direction when the slider is not fitted in the housing; and the housing further comprises a pair of second cutouts at portions of the housing near both sides of the upper face of the housing, the protrusions of the lock arms in the recess are exposed through the respective second cutouts when the slider is fitted in the housing, and the protrusions of the lock arms in the recess are not exposed through the second cutouts when the slider is not fitted in the housing.

In the connector, it is preferable that the housing comprises on its rear face a pair of third cutouts, and the slider comprises a pair of protrusions corresponding in position and shape to the respective third cutouts; and the protrusions of the slider are fitted in the respective third cutouts of the housing when the slider is fitted in the housing, and the protrusions of the slider are not fitted in the respective third cutouts of the housing when the slider is not fitted in the housing. According to this feature, a worker can more surely check whether or not the slider has been fitted in the housing.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

First Embodiment

Figure 1:
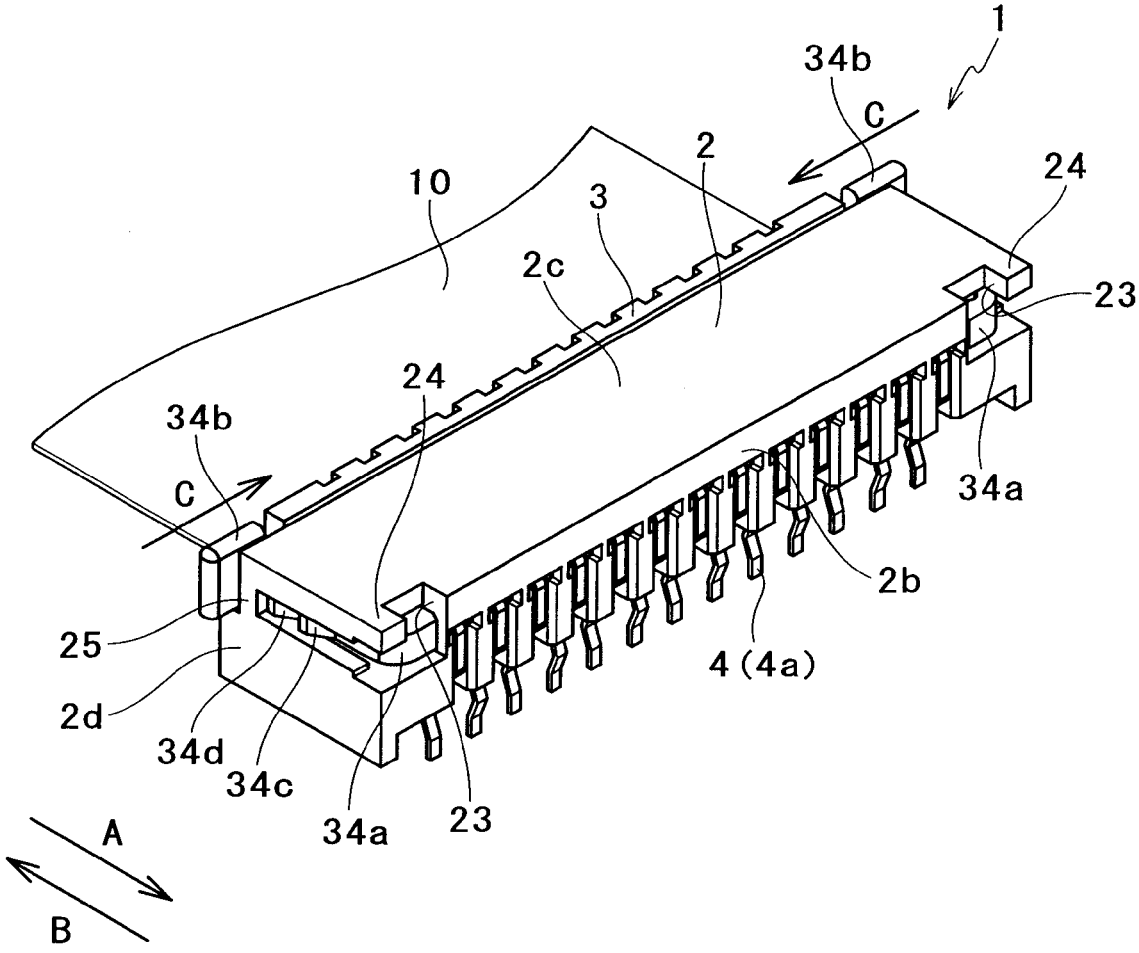
FIG. 1 is a perspective view of a housing and a slider of a connector according to a first embodiment of the present invention in a fitted state.
Figure 2:
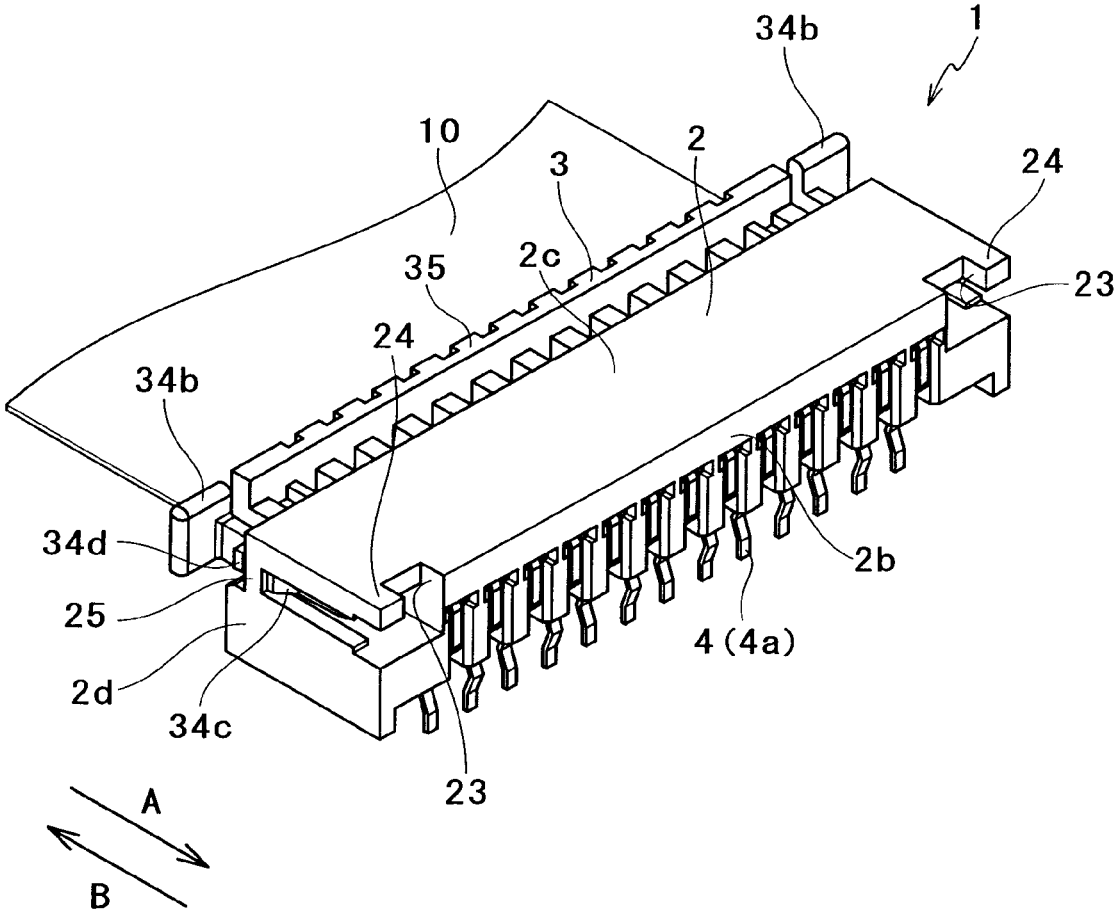
FIG. 2 is a perspective view of the housing and the slider of the connector of FIG. 1 in a non-fitted state.

FIG. 1 is a perspective view of a housing and a slider of a connector according to a first embodiment of the present invention in a fitted state. FIG. 2 is a perspective view of the housing and the slider of the connector according to the first embodiment shown in FIG. 1, in a non-fitted state. FIGS. 3 to 9 are for explaining details of the connector according to the first embodiment shown in FIG. 1.

As shown in FIGS. 1 and 2, the connector 1 of the first embodiment is for electrically connecting a flexible substrate 10 to a not-shown printed circuit board. The connector 1 is made up of a black housing 2 and a gray slider 3. Either of the housing 2 and the slider 3 is made of an insulating material. The connector 1 is a side type connector in which the flexible substrate 10 is inserted in and pulled out of the housing 2, which is to be mounted on the printed circuit board, parallel to the mounting surface of the printed circuit board, that is, horizontally, more specifically, in directions A and B shown by arrows in FIG. 1.

Figure 3:
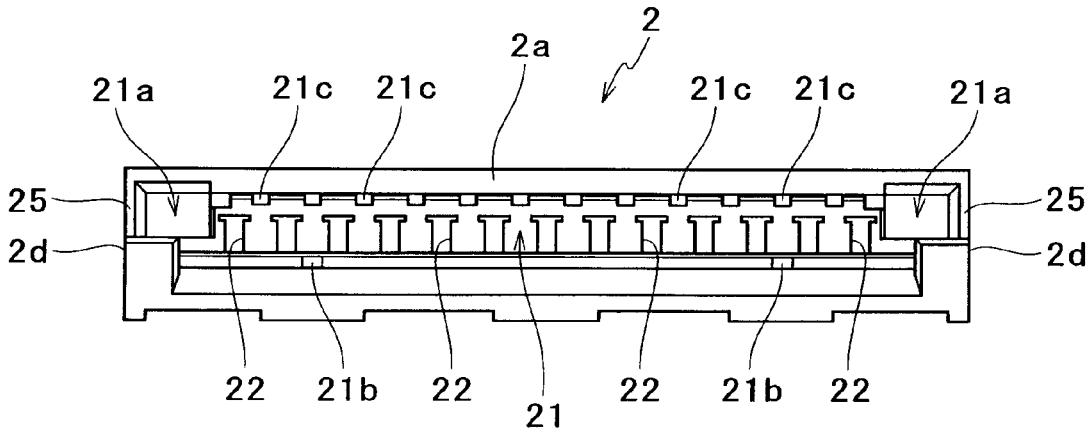
FIG. 3 is a front view of the housing of the connector of FIG. 1.

As shown in FIG. 3, an opening of a recess 21 is formed on the rear face 2*a* of the housing 2 for inserting the slider 3 and the flexible substrate 10. The housing 2 has a number of through holes 22 each extending from the bottom face of the recess 21 to the front face 2*b* of the housing 2. A substantially L-shaped contact 4 is provided in each through hole 22. One end of each contact 4 is located outside the housing 2 in order to be connected to an electric wire provided on the printed circuit board. Not-shown other end of each contact 4 is located in the recess 21 in order to be connected to a contact on the flexible substrate 10 inserted in the recess 21.

Figure 5:
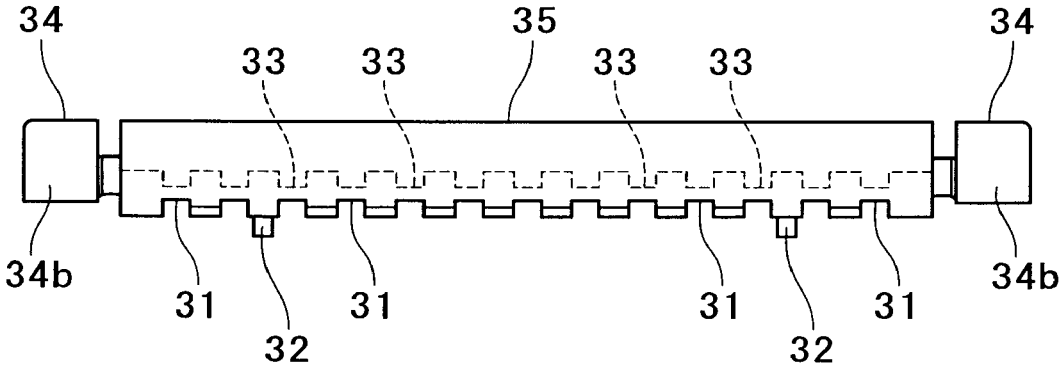
FIG. 5 is a rear view of the slider of the connector of FIG. 1.
Figure 7:
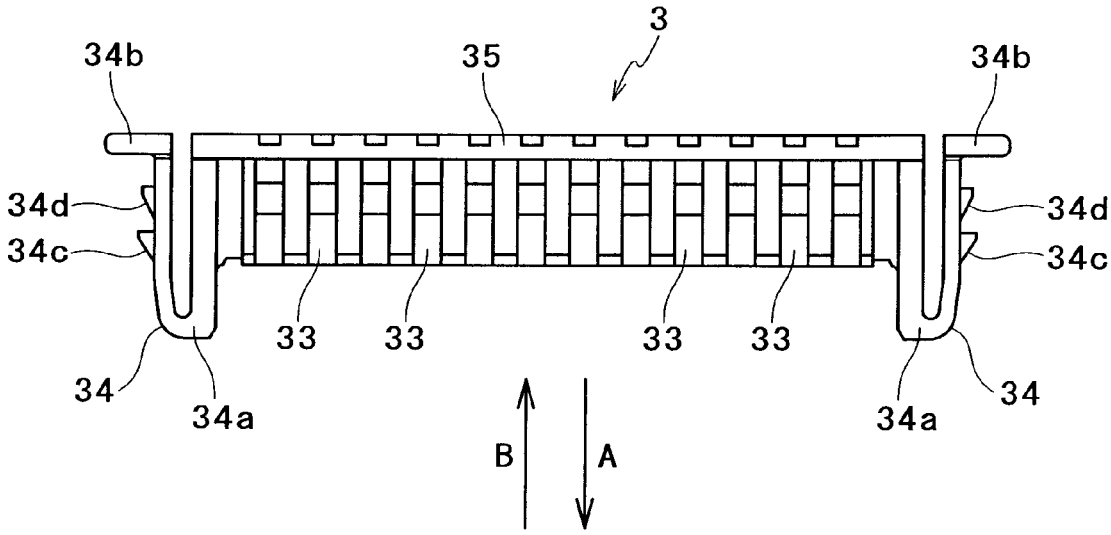
FIG. 7 is a plan view of the slider of the connector of FIG. 1.

Both sides of the recess 21 are formed into a pair of receiving holes 21*a* that movably receive therein a pair of lock arms 34 provided on the slider 3. Each receiving hole 21*a* is open at both the rear and front faces 2*a* and 2*b* of the housing 2. A pair of cutouts 21*b* are formed on the lower wall surface of the recess 21 at a predetermined interval. The cutouts 21*b* are formed at positions corresponding to a pair of nails 32 provided on the slider 3 as shown in FIG. 5, respectively. A number of protrusions 21*c* each extending in the direction A are formed on the upper wall surface of the recess 21 at predetermined intervals. The protrusions 21*c* are formed so as to correspond to a number of grooves 33 formed on the slider 3 as shown in FIGS. 5 and 7, respectively. The protrusions 21*c* and the grooves 33 serve for guiding the slider 3 in the directions A and B.

Figure 4:
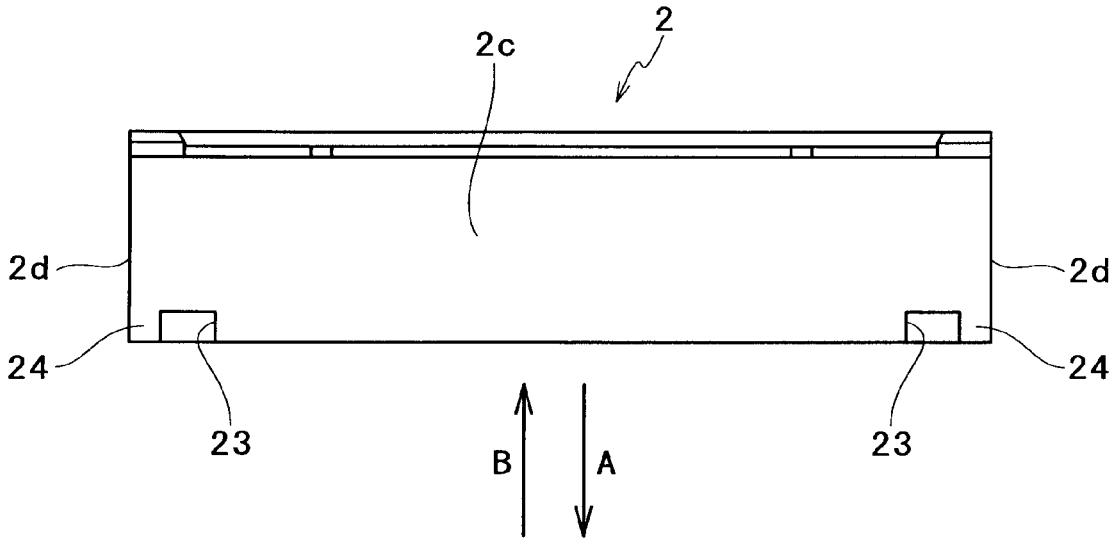
FIG. 4 is a plan view of the housing of the connector of FIG. 1.

As shown in FIGS. 1, 2, and 4, a pair of cutouts 23 are formed at the front end of the upper face 2*c* of the housing 2 near both sides, that is, the longitudinal ends, of the housing 2 for exposing the front ends 34*a* of the lock arms 34. The cutouts 23 are formed at positions corresponding to the front ends 34*a* of the respective lock arms 34. The cutouts 23 are distant inside from both sides of the housing 2 at a predetermined distance. Near each cutout 23, a corner portion 24 is defined by the upper face 2*c*, a side face 2*d*, and the front face 2*b*, which are perpendicularly connected to each other. An engagement wall 25 is formed at the rear end of each side face 2*d*. The engagement wall 25 has its front face as an engagement face that engages with protrusions 34*c* and 34*d* of the corresponding lock arm 3, as will be described later.

Figure 6:
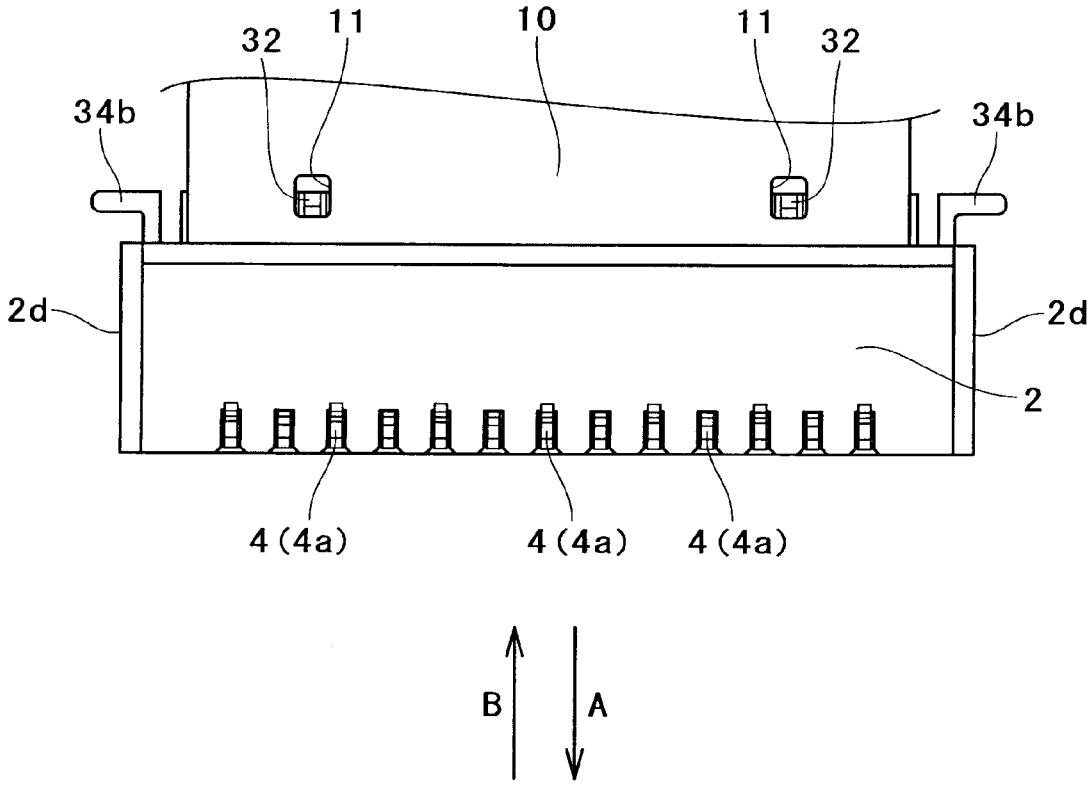
FIG. 6 is a bottom view of the connector of FIG. 1.

The slider 3 is inserted in the recess 21 of the housing 2 so that the other ends of the contacts 4 provided in the respective through holes 22 of the housing 2 are connected to contacts of the flexible substrate 10 inserted in the recess 21 of the housing 2. More specifically, the slider 3 moving in the direction A comes into contact with the other ends of the contacts 4 disposed in the recess 21 to push down the other ends of the contacts 4. Thereby, the contacts 4 are electrically connected to not-shown contacts formed on the upper face of the flexible substrate 10 inserted in the recess 21. As shown in FIGS. 5 and 6, a number of grooves 31 are formed on the lower face of the slider 3 at predetermined intervals. The other ends of the contacts 4 in the recess 21 are pressed onto the inner walls of the respective grooves 31. A pair of nails 32 are provided on the lower face of the slider 3 at a predetermined interval. As shown in FIG. 6, the nails 32 are inserted in a pair of holes 11 formed on the flexible substrate 10 to move the flexible substrate 10 with the movement of the slider 3. The pair of nails 32 are provided so as to correspond to a pair of cutouts 21*b* formed on the lower surface of the recess 21 of the housing 2 as shown in FIG. 3. When the slider 3 is fitted in the housing 2, the nails 32 engage with the respective cutouts 21*b* of the housing 2. As shown in FIGS. 5 and 7, a number of grooves 33 are formed on the upper face of the slider 3 at predetermined intervals so as to correspond to the respective protrusions 21*c* of the housing 2 as shown in FIG. 3. Because the protrusions 21*c* of the housing 2 engage with the respective grooves 33, the slider 3 can be easily moved in the direction A.

As shown in FIG. 7, a pair of elastically deformable lock arms 34 are provided at both sides of the slider 3. The lock arms 34 serve to fix the slider 3 to the housing 2 when the slider 3 is fitted in the housing 2. Each lock arm 34 extends from its front end 34*a* in the direction A toward the rear end. Each lock arm 34 has a grip 34*b* to be gripped by a worker, and two protrusions 34*c* and 34*d* protruding from the outer side surface of the lock arm 34. The protrusions 34*c* and 34*d* are arranged in the direction A. Either of the protrusions 34*c* and 34*d* is tapered toward the front end 34*a*. As shown in FIG. 2, when the slider 3 is not fitted in the housing 2, the protrusion 34*c* nearer to the front end 34*a* is in front of the engagement wall 25 of the housing 2 while the other protrusion 34*d* is behind the engagement wall 25 of the housing 2. On the other hand, as shown in FIG. 1, when the slider 3 is fitted in the housing 2, both the protrusions 34*c* and 34*d* are in front of the engagement wall 25. The grip 34*b* is used when the housing 2 and the slider 3 are released from a fitted state. At this time, a worker elastically deforms the grip 34*b* of each lock arm 34 in a direction C from a fitted state shown in FIG. 8. Thereby, the protrusion 34*d* of each lock arm 34 is released from engagement with the corresponding engagement wall 25 of the housing 2. The worker then moves the slider 3 in the direction B. Thereby, the protrusion 34*d* of each lock arm 34 is moved behind the corresponding engagement wall 25. Thus, the housing 2 and the slider 3 are put in a non-fitted state.

Figure 8:
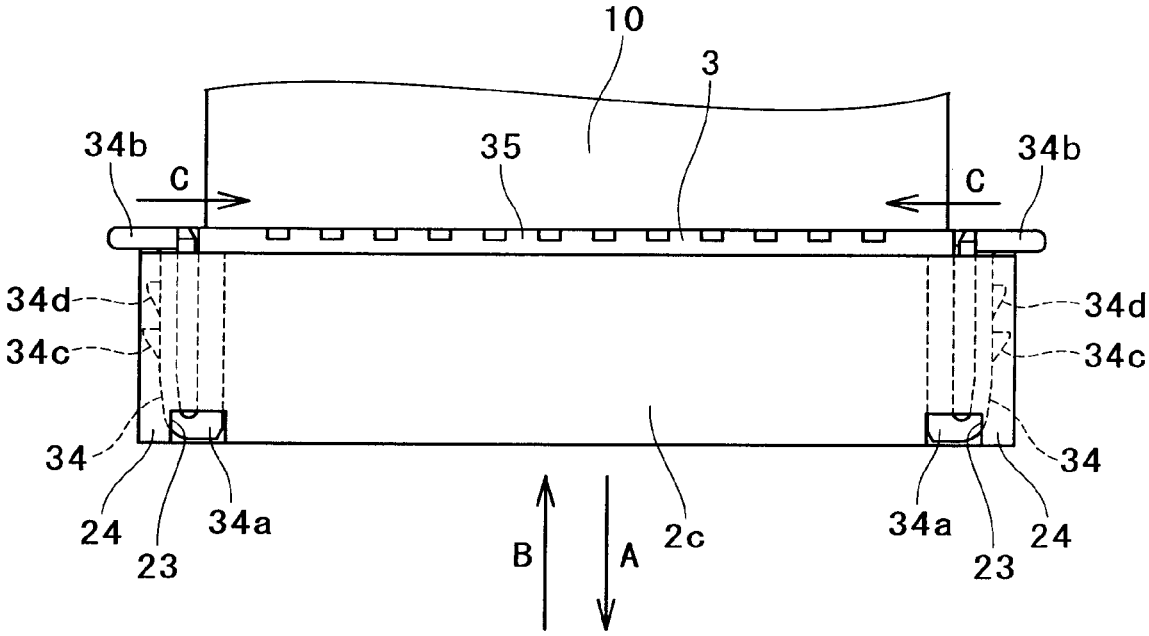
FIG. 8 is a plan view of the housing and the slider of the connector of FIG. 1 in a fitted state.

As shown in FIGS. 2, 5, and 7, a rib 35 is formed at an upper portion of the slider 3. When the slider 3 is fitted in the housing 2, the rib 35 comes into contact with the rear face 2*a* of the housing 2 as shown in FIG. 3. As shown in FIGS. 1 and 8, when the slider 3 is fitted in the housing 2, there is no clearance between the rear face 2*a* of the housing 2 and the rib 35.

Next will be described a method of attaching the flexible substrate 10 to the connector 1 and a method of detaching the flexible substrate 10 from the connector 1.

When the flexible substrate 10 is attached to the connector 1, first, the slider 3 and the housing 2 are put in a non-fitted state in which the protrusion 34*d* of each lock arm 34 is behind the corresponding engagement wall 25 of the housing 2. In this state, as shown in FIG. 6, a pair of nails 32 formed on the lower face of the slider 3 are engaged with a pair of holes 11 of the flexible substrate 10, respectively. A worker then pushes the slider 3 in the direction A in the above state, that is, the state shown in FIGS. 2, 6, and 9. Because the slider 3 is thereby moved in the direction A, the protrusion 34*d* of each lock arm 34 gets over the corresponding engagement wall 25 of the housing 2 and engages with the front surface of the engagement wall 25 of the housing 2. Thereby, the slider 3 is fixed to the housing 2. The fitted state shown in FIGS. 1 and 8 is thus established. When the slider 3 is moved in the direction A, the flexible substrate 10 engaging with the pair of nails 32 of the slider 3 is also moved in the direction A. Thus, the contacts on the flexible substrate 10 are inserted in the recess 21. Further, when the slider 3 and the housing 2 are put in the fitted state, the other end of each contact 4 being pressed onto the inner wall of the corresponding groove 31 of the slider 3, as shown in FIG. 5, is connected to the corresponding contact on the flexible substrate 10 in the recess 21. At this time, the flexible substrate 10 disposed between the lower face of the slider 3 and the lower surface of the recess 21 of the housing 2 is sandwiched by the lower face of the slider 3 and the lower surface of the recess 21 of the housing 2 to be fixed. The flexible substrate 10 is thus attached to the connector 1.

When the housing 2 and the slider 3 are thus put in the fitted state, as shown in FIGS. 1 and 8, the front ends 34*a* of a pair of lock arms 34 are exposed through a pair of cutouts 23 of the housing 2, respectively. Therefore, the worker can visually confirm that the housing 2 and the slider 3 is in a fitted state. This scarcely causes erroneous confirmation even under an environment in which noises or vibrations are being generated. If the front end 34*a* of any lock arm 34 is not exposed through the corresponding cutout 23 of the housing 2, the worker can know that the housing 2 and the slider 3 is in a non-fitted state. If the front end 34*a* of only one lock arm 34 is exposed through the corresponding cutout 23 of the housing 2, the worker can know that the housing 2 and the slider 3 is in a semi-fitted state.

When the flexible substrate 10 is detached from the connector 1, first, the worker elastically deforms the grips of both lock arms 34 shown in FIGS. 1 and 8 in the direction C. The worker then moves the slider 3 in the direction B. Thereby, the protrusion 34*d* of each lock arm 34 gets over the corresponding engagement wall 25 of the housing 2. The housing 2 and the slider 3 is thus put in a non-fitted state. When the slider 3 is moved in the direction B, the flexible substrate 10 engaging with a pair of nails 32 of the slider 3 is also moved in the direction B. Thereby, each contact on the flexible substrate 10 is disconnected from the corresponding contact 4 provided in the housing 2. Afterward, the pair of nails 32 of the slider 3 are released from engagement with the respective holes 11 of the flexible substrate 10. The flexible substrate 10 is then detached from the connector 1.

Figure 9:
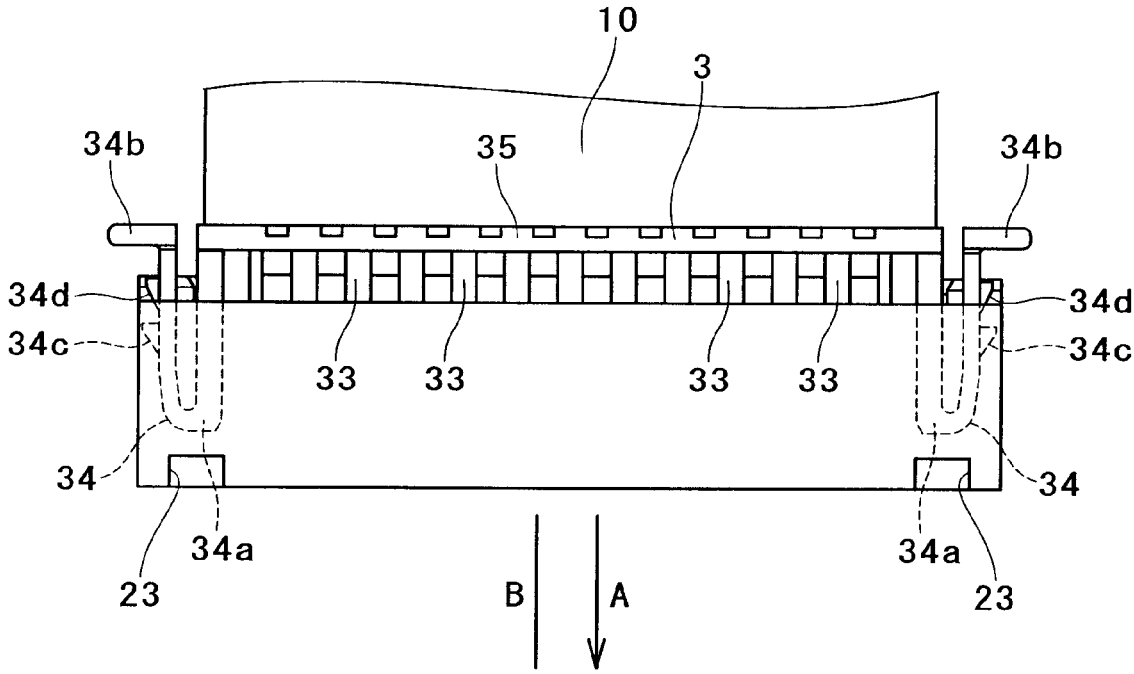
FIG. 9 is a plan view of the housing and the slider of the connector of FIG. 1 in a non-fitted state.

When the housing 2 and the slider 3 are thus put in a non-fitted state, as shown in FIGS. 2 and 9, the front end 34*a* of any lock arm 34 is not exposed through the corresponding cutout 23 of the housing 2. Thus, the worker can confirm that the housing 2 and the slider 3 is in a non-fitted state.

In the first embodiment, as described above, a pair of cutouts 23 is provided at the front end of the upper face 2*c* of the housing 2 near both sides of the housing 2. When the slider 3 is fitted in the housing 2, the front ends 34*a* of a pair of lock arms 34 are exposed through the respective cutouts 23. When the slider 3 is not fitted in the housing 2, the front ends 34*a* of the lock arms 34 are not exposed through the respective cutouts 23. Therefore, in operating the slider 3 or a checking process, the worker can easily check with eyes whether or not the slider 3 has been fitted in the housing 2. More specifically, when the front ends 34*a* of the lock arms 34 are exposed through the respective cutouts 23, the worker can confirm that the housing 2 and the slider 3 are in a fitted state. When only one lock arm 34 is exposed through the corresponding cutout 23 or any lock arm 34 is not exposed through the corresponding cutout 23, the worker can confirm that the housing 2 and the slider 3 is in a semi-fitted or non-fitted state. This can prevent the housing 2 and the slider 3 from being left in the semi-fitted or non-fitted state. As a result, the connector 1 can be obtained in which each contact 4 in the housing 2 is surely connected to the corresponding contact on the flexible substrate 10.

In addition, corner portions 24 are provided each of which is defined by the upper face 2*c*, a side face 2*d*, and the front face 2*b* of the housing 2, which are perpendicularly connected to each other. By using the corner portions 24 for positioning when a pair of cutouts 23 are formed, each cutout 23 can be formed at an accurate position.

Further, because the housing 2 and the slider 3 are different in color, this makes it easy to check whether or not the front ends 34*a* of the lock arms 34 of the slider 3 are exposed through the respective cutouts 23 of the housing 2.

Second Embodiment

Figure 10:
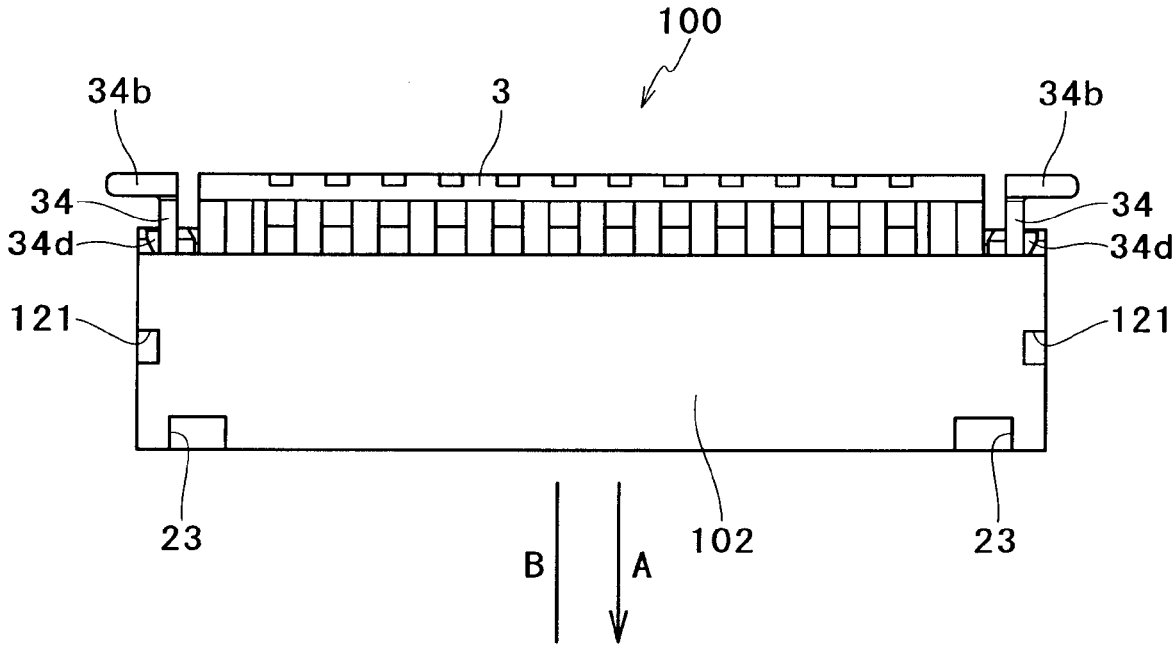
FIG. 10 is a plan view of a housing and a slider of a connector according to a second embodiment of the present invention in a non-fitted state.
Figure 11:
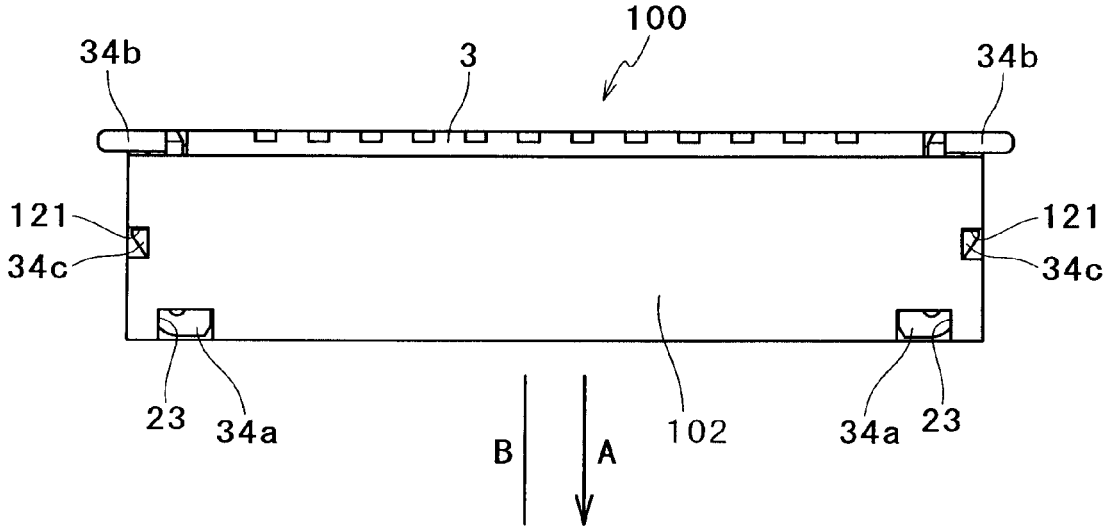
FIG. 11 is a plan view of the housing and the slider of the connector of FIG. 10 in a fitted state.

FIG. 10 is a plan view of a housing and a slider of a connector according to a second embodiment of the present invention in a non-fitted state. FIG. 11 is a plan view of the housing and the slider of the connector according to the second embodiment shown in FIG. 10 in a fitted state. The second embodiment has the same construction as the above-described first embodiment except that a pair of cutouts 121 are formed on the housing 102. The same construction as the first embodiment will be omitted.

In the connector 100 of the second embodiment, a pair of cutouts 121 are formed at both side portions on the upper face of the housing 102. The cutouts 121 allow the protrusions 34*c* of the respective lock arms 34 to be exposed when the slider 3 and the housing 102 are in a fitted state as shown in FIG. 11. Further in this state, the front ends 34*a* of the lock arms 34 are exposed through the respective cutouts 23 of the housing 102. When the slider 3 and the housing 102 are in a non-fitted state as shown in FIG. 10, the protrusions 34*c* of the lock arms 34 are not exposed through the cutouts 121. In the non-fitted state, the front ends 34*a* of the lock arms 34 are also not exposed through the cutouts 23 of the housing 102.

In the second embodiment, as described above, a worker can see the protrusions 34*c* of the lock arms 34 through the respective cutouts 121 when the slider 3 and the housing 102 are in a fitted state. That is, the worker can see the respective lock arms 34 through not only the pair of cutouts 23 but also the pair of cutouts 121. Thus, the worker can more surely check the fitted state of the slider 3 and the housing 102. In addition, also in the second embodiment, the same effects as the above-described first embodiment are obtained.

Third Embodiment

Figure 12:
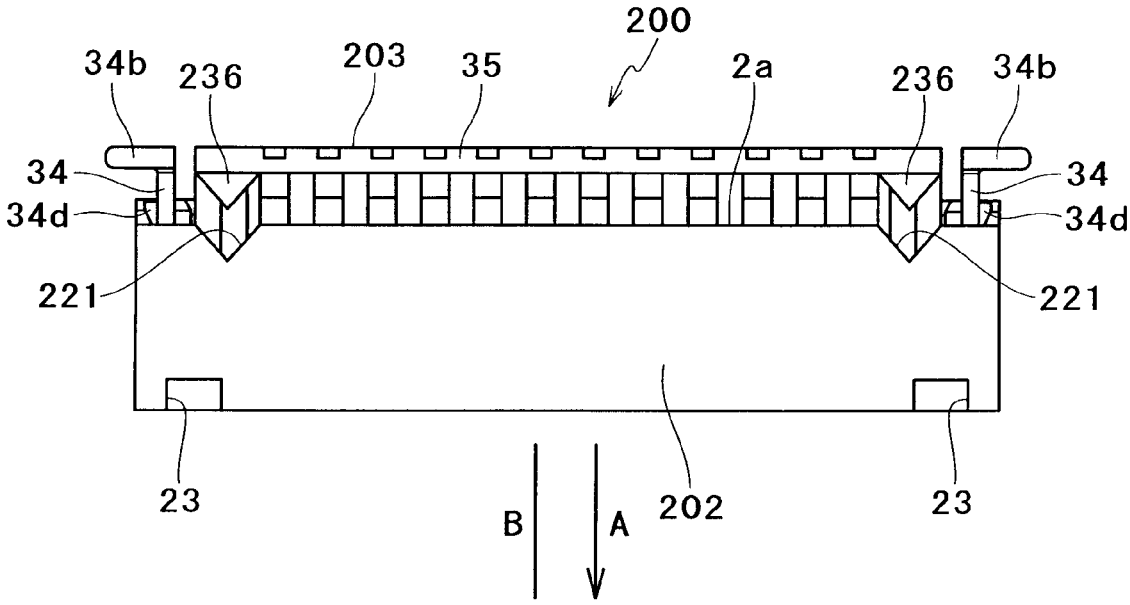
FIG. 12 is a plan view of a housing and a slider of a connector according to a third embodiment of the present invention in a non-fitted state.
Figure 13:
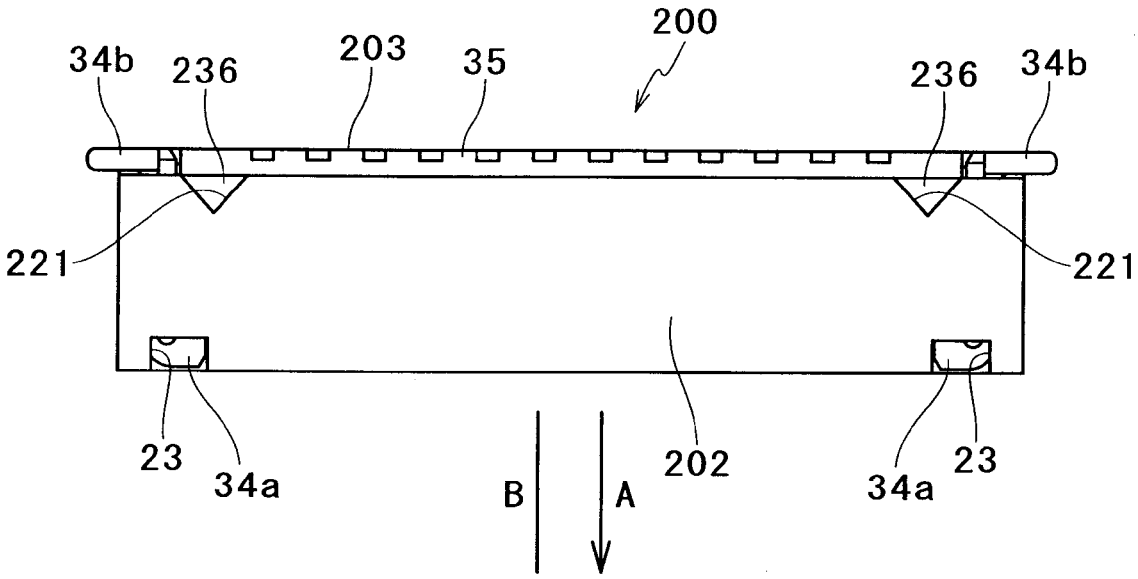
FIG. 13 is a plan view of the housing and the slider of the connector of FIG. 12 in a fitted state.

FIG. 12 is a plan view of a housing and a slider of a connector according to a third embodiment of the present invention in a non-fitted state. FIG. 13 is a plan view of the housing and the slider of the connector according to the third embodiment shown in FIG. 12 in a fitted state. The third embodiment has the same construction as the above-described first embodiment except that a pair of cutouts 221 are formed on the housing 202 and a pair of protrusions 236 are formed on the slider 203 so as to have their shapes corresponding to the respective cutouts 221. The same construction as the first embodiment will be omitted.

In the connector 200 of the third embodiment, a pair of cutouts 221 are formed at the rear end of the upper face of the housing 202. On the rib 35 of the slider 203, a pair of protrusions 236 are formed so as to correspond in shape and position to the respective cutouts 221. When the slider 303 and the housing 202 are in a fitted state as shown in FIG. 13, the protrusions 236 are fitted in the respective cutouts 221. When the slider 303 and the housing 202 are in the fitted state, the front ends 34*a* of the lock arms 34 are exposed through the respective cutouts 23 of the housing 202. When the slider 303 and the housing 202 are in a non-fitted state as shown in FIG. 12, the protrusions 236 are not fitted in the respective cutouts 221. When the slider 303 and the housing 202 are in the non-fitted state, the front ends 34*a* of the lock arms 34 are not exposed through the respective cutouts 23 of the housing 202.

In the third embodiment, as described above, a worker can see a fitted state between the cutouts 221 of the housing 202 and the protrusions 236 of the slider 3. Therefore, the worker can check a fitted state between the slider 203 and the housing 202, not only through a pair of cutouts 23 but also by the fitted state between the cutouts 221 and the protrusions 236. Thus, the worker can more surely check the fitted state of the slider 203 and the housing 202. In addition, also in the third embodiment, the same effects as the above-described first embodiment are obtained.

In the above-described embodiments, a pair of cutouts 23 are formed at the front end of the upper face 2*c* of the housing 2, 102, or 202. However, the present invention is not limited to that. Such cutouts may be formed at any other portions if part of each lock arm 34 in the recess can be exposed through the corresponding cutout. Further, through holes may be formed in place of the cutouts.

In the above-described embodiments, the connector 1, 100, or 200 is made up of a black housing and a gray slider. However, the colors of the housing and the slider of the present invention are not limited to those. Further, the housing and the slider may have the same color.

Figure 14:
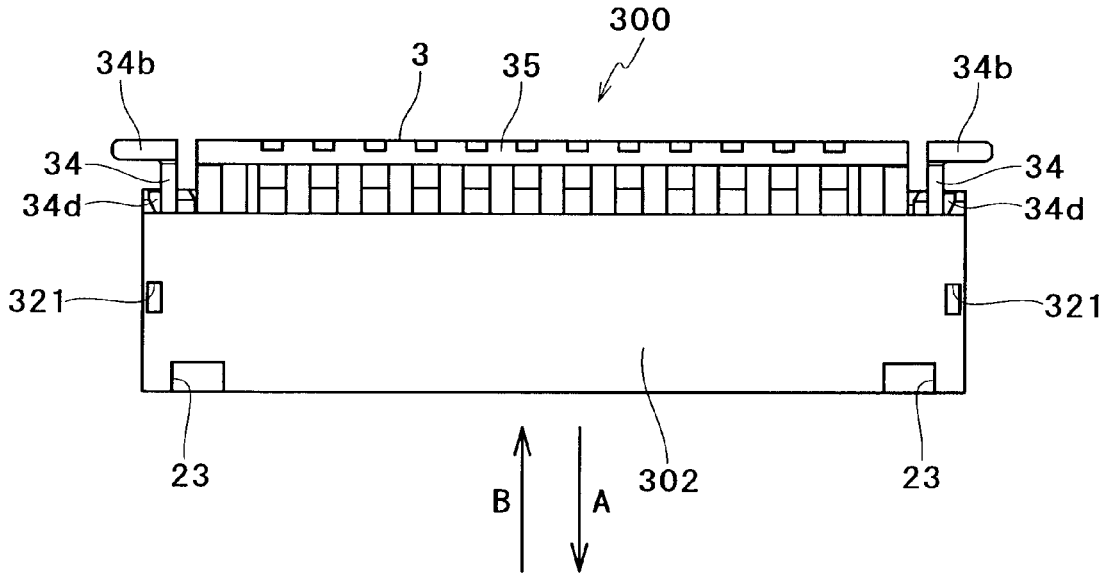
FIG. 14 is a plan view of a housing and a slider of a connector according to a modification of the second embodiment of the present invention in a non-fitted state.
Figure 15:
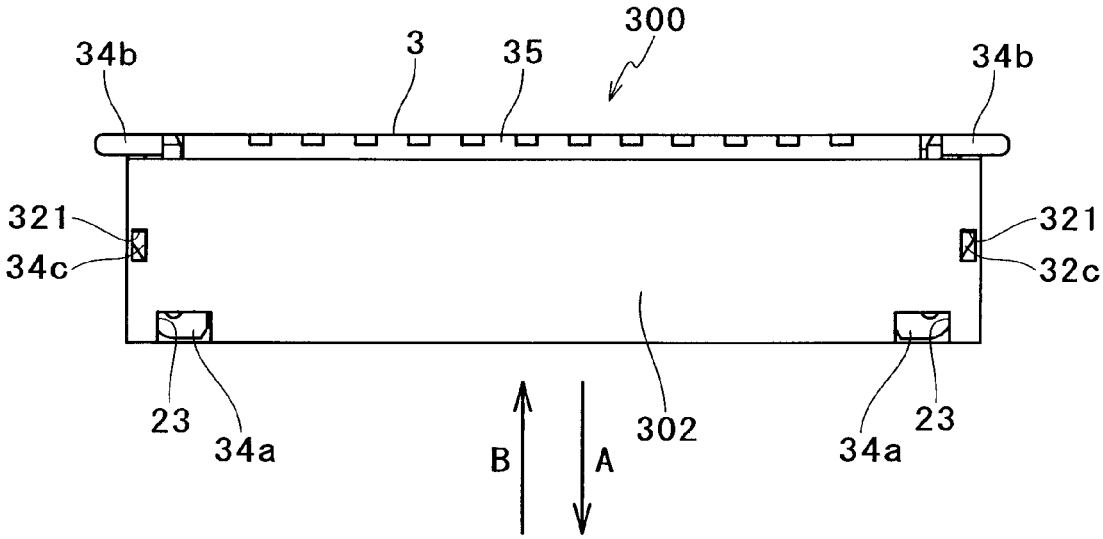
FIG. 15 is a plan view of the housing and the slider of the connector according to the modification of the second embodiment of the present invention in a fitted state.

In the above-described second embodiment, as shown in FIGS. 10 and 11, a pair of cutouts 121 are formed near both longitudinal ends of the housing 102. However, the present invention is not limited to that. In a modification of the second embodiment, as shown in FIGS. 14 and 15, a pair of through holes 321 may be formed near both sides of the housing 302. When the slider 3 and the housing 302 is in a fitted state as shown in FIG. 15, the protrusions 34*c* of the lock arms 34 are exposed through the respective through holes 321. When the slider 3 and the housing 302 is in a non-fitted state as shown in FIG. 14, the protrusions 34*c* of the lock arms 34 are not exposed through the respective through holes 321. In the modification, by checking whether or not the protrusion 34*c* of each lock arm 34 is exposed through the corresponding through hole 321 of the housing 302, and checking whether or not the front end 34*a* of each lock arm 34 is exposed through the corresponding cutout 23, a worker can judge in which of a fitted, non-fitted, and semi-fitted states the housing 302 and the slider 3 are.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A connector comprising:

a housing on which a contact is attached, the housing comprising a recess extending parallel to a mounting surface of a printed circuit board on which the housing is to be mounted, the recess comprising at its rear end an opening; and a slider to be inserted in the recess through the opening, and slid in the recess to be fitted in the housing, a flexible substrate being to be inserted in the recess with the slider so that a contact on the flexible substrate is connected to the contact on the housing, the slider comprising on its both sides a pair of lock arms to fix the slider to the housing when the slider is fitted in the housing, parts of the respective lock arms in the recess being exposed out of the housing at portions of the housing near both sides of an upper face of the housing when the slider is fitted in the housing, and either of the lock arms in the recess being not exposed out of the housing when the slider is not fitted in the housing, each portion of the housing where each lock arm is exposed out of the housing being provided near a corner portion where the upper face, a side face, and a front face of the housing are perpendicularly connected to each other.

2. The connector according to claim 1, wherein the housing and the slider are different in color.

3. The connector according to claim 1, wherein front ends of the respective lock arms in an insertion direction of the slider into the recess are exposed out of the housing when the slider is fitted in the housing.

4. The connector according to claim 3, wherein the housing comprises first cutouts formed at an front end of the upper face of the housing, and the front ends of the lock arms are exposed through the respective first cutouts when the slider is fitted in the housing.

5. The connector according to claim 1, wherein two portions of each lock arm are exposed out of the housing when the slider is fitted in the housing.

6. The connector according to claim 5, wherein each lock arm is elastically deformable perpendicularly to an insertion direction of the slider into the recess;

each lock arm comprises on its outer side surface a protrusion, and the housing comprises on its both sides a pair of engagement faces that engage with the protrusions of the respective lock arms so as to prevent the slider from sliding in the direction opposite to the insertion direction when the slider is fitted in the housing; and the housing further comprises a pair of through holes at portions of the housing near both sides of the upper face of the housing, the protrusions of the lock arms in the recess are exposed through the respective through holes when the slider is fitted in the housing, and the protrusions of the lock arms in the recess are not exposed through the through holes when the slider is not fitted in the housing.

7. The connector according to claim 5, wherein each lock arm is elastically deformable perpendicularly to an insertion direction of the slider into the recess;

each lock arm comprises on its outer side surface a protrusion, and the housing comprises on its both sides a pair of engagement faces that engage with the protrusions of the respective lock arms so as to prevent the slider from sliding in the direction opposite to the insertion direction when the slider is not fitted in the housing; and the housing further comprises a pair of second cutouts at portions of the housing near both sides of the upper face of the housing, the protrusions of the lock arms in the recess are exposed through the respective second cutouts when the slider is fitted in the housing, and the protrusions of the lock arms in the recess are not exposed through the second cutouts when the slider is not fitted in the housing.

8. The connector according to claim 1, wherein the housing comprises on its rear face a pair of third cutouts, and the slider comprises a pair of protrusions corresponding in position and shape to the respective third cutouts; and the protrusions of the slider are fitted in the respective third cutouts of the housing when the slider is fitted in the housing, and the protrusions of the slider are not fitted in the respective third cutouts of the housing when the slider is not fitted in the housing.

* * * * *